United States Patent [19]

Connoy

[11] 4,391,539

[45] Jul. 5, 1983

[54] TAPE-RIBBON PRINTING CARTRIDGE

[75] Inventor: Thomas P. Connoy, Lino Lakes, Minn.

[73] Assignee: Kroy Inc., St. Paul, Minn.

[21] Appl. No.: 152,709

[22] Filed: May 23, 1980

[51] Int. Cl.[3] ..... B41J 33/14

[52] U.S. Cl. ..... 400/208; 400/134.6; 400/248; 400/613; 400/618

[58] Field of Search ..... 400/134.5, 134.6, 196.1, 400/208, 613, 617, 618, 654, 235.1, 236.1, 248

[56] References Cited

U.S. PATENT DOCUMENTS

| | | | |
|---|---|---|---|
| 2,107,603 | 2/1938 | Ellenburg | 242/55.4 |
| 2,329,129 | 9/1943 | Mehan | 400/208 |
| 2,647,577 | 8/1953 | White | 206/391 X |
| 2,668,021 | 2/1954 | Gleason | 242/71.2 X |
| 2,930,469 | 3/1960 | Roggenstein | 400/208.1 |
| 3,127,989 | 4/1964 | Travaglio | 400/613 X |
| 3,129,813 | 4/1964 | Norvelle | 400/134.5 X |
| 3,342,298 | 9/1967 | Whitesel | 400/6 |
| 3,401,782 | 9/1968 | Shepard, Jr. | 400/617 |
| 3,513,957 | 5/1970 | Ricciardi et al. | 400/248 X |
| 3,568,812 | 3/1971 | Eitel | 400/618 |
| 3,593,833 | 7/1971 | Bretti | 400/613 X |
| 3,637,060 | 1/1972 | McMahon | 400/134.5 |
| 3,698,296 | 10/1972 | Heuser et al. | 400/134.5 X |
| 3,799,315 | 3/1974 | Stewart | 400/208 |
| 3,804,227 | 4/1974 | Cappotto et al. | 400/208 |
| 3,804,351 | 4/1974 | Kaneko et al. | 242/199 |
| 3,834,507 | 9/1974 | Bradshaw | 400/134.6 |
| 3,863,749 | 2/1975 | Perry et al. | 400/208 |
| 3,897,866 | 8/1975 | Mueller | 400/248 X |
| 3,897,867 | 8/1975 | Shattuck et al. | 400/208 |
| 3,904,017 | 9/1975 | Frechette | 400/196.1 |
| 3,912,064 | 10/1975 | Bluem et al. | 400/134.6 |
| 4,011,940 | 3/1977 | Neal et al. | 206/1.5 |
| 4,015,700 | 4/1977 | Paque | 400/617 |
| 4,058,197 | 11/1977 | West | 242/75.4 |
| 4,088,218 | 5/1978 | Depew | 400/208 |
| 4,108,556 | 8/1978 | Connoy | 400/654 X |
| 4,124,172 | 11/1978 | Verch | 242/75.4 X |
| 4,131,373 | 12/1978 | Rakow | 400/208 |
| 4,226,547 | 10/1980 | Bradshaw et al. | 400/613 |
| 4,239,399 | 12/1980 | Johnstun | 400/613 X |
| 4,243,333 | 1/1981 | Bradshaw et al. | 400/613 X |
| 4,247,210 | 1/1981 | Kacmarcik et al. | 400/236.1 |

FOREIGN PATENT DOCUMENTS

| | | | |
|---|---|---|---|
| 2553329 | 5/1976 | Fed. Rep. of Germany | 400/208 |
| 2811346 | 9/1979 | Fed. Rep. of Germany | 400/208 |

OTHER PUBLICATIONS

IBM Technical Disclosure Bulletin, "Erase Ribbon Lift and Advancing Mechanism", Mathews, vol. 19, No. 7, Dec. 1976, pp. 2393-2394.

*Primary Examiner*—Ernest T. Wright, Jr.
*Attorney, Agent, or Firm*—Dorsey & Whitney

[57] ABSTRACT

A printing cartridge for supplying image carrying tape and printing ribbon in a printing apparatus including a cartridge housing comprising a tape and ribbon supply section and an elongated guide section rigidly and integrally joined with the supply section, a spool of image carrying tape rotatably supported within the tape and ribbon supply section and a supply of printing ribbon disposed within the tape and ribbon supply section. The printing cartridge also includes a wall section for retaining the spool of image carrying tape in a generally circular configuration, a device for limiting the movement of the image carrying tape from the tape and ribbon supply section in a forward direction only, an improved guide structure for guiding the tape and ribbon through the elongated guide section and an improved structure for aligning the cartridge with respect to a cartridge carrier.

9 Claims, 8 Drawing Figures

24
13d
11
13c
44
29
50
26
45
30
33
11a
14
50
48
31
47
16
46
42
32
51
9
24
25
49
41
13a
39
35
24
40
24
38
13b
36
24
10
13d
27
28
16
12a
12
13a
15

TAPE-RIBBON PRINTING CARTRIDGE

BACKGROUND AND SUMMARY OF THE INVENTION

The present invention relates generally to an improved printing cartridge, and more specifically, to an improved tape-ribbon cartridge adapted for use in a printing apparatus or composing system. The present cartridge has particular application in a printing apparatus or composing system having a cartridge carrier or receiver in which the means for advancing the tape and ribbon into printing registration with the printing station includes means for reciprocally moving the cartridge carrier or receiver, and thus the cartridge, toward and away from the printing station.

Tape-ribbon printing cartridges adapted for use in connection with such printing equipment exists in the prior art. An example of such a printing cartridge is described in U.S. Pat. No. 4,226,547 issued Oct. 7, 1980. While this printing cartridge is generally an acceptable cartridge, there are several ways in which the same can be improved.

The printing cartridge of the present invention relates to an improved tape-ribbon printing cartridge with several improved features. First, the printing cartridge of the present invention provides an improved means for properly aligning the cartridge and retaining the same in an operative position within the cartridge receiver. Secondly, it provides an improved means for preventing the spool of tape within the cartridge from settling into the corners of the cartridge. Thirdly, it provides an improved means for guiding and supporting the tape and ribbon and maintaining separation between the same as they are withdrawn from the cartridge. Fourthly, the present invention provides improved means for permitting forward movement of the tape and ribbon from the cartridge, but preventing rearward movement, thus facilitating use of the cartridge in a printing apparatus of the type described above.

More specifically, the cartridge of the present invention comprises a pair of rigid half sections which are joined together to form a tape and ribbon supply cavity and a guide means for guiding the tape and ribbon therefrom. In the preferred embodiment, the guide means includes a relatively rigid guide portion extending outwardly from the main housing of the cartridge. This elongated guide section includes a vertically extending recessed portion on its underside for engagement with a corresponding vertically extending wall portion or alignment tab of a cartridge receiver. Means are also provided on the main body of the cartridge housing in the form of recessed portions to cooperate with retaining ribs positioned within the cartridge receiver cavity.

The means for preventing the tape from settling into the corners of the cartridge include a wall section or tape retaining barrier of generally circular configuration. This maintains the supply of tape within the cartridge in a generally circular configuration and prevents the same from unwinding and settling into the corners of the cartridge. This tape retaining barrier allows the tape retaining discs necessary in prior art cartridges to be eliminated.

The means allowing the tape and ribbon to be withdrawn from the cartridge, but preventing rearward movement of the tape and ribbon back into the cartridge includes a flexible bias member disposed against the underside of the tape. This particular feature facilitates the use of the cartridge of the present invention with a printing apparatus having a cartridge receiver in which the printing tape and ribbon is advanced by reciprocal movement of the printing cartridge toward and away from the printing station.

Accordingly, an object of the present invention is to provide an improved printing cartridge for supplying tape and ribbon to the printing station of a printing apparatus in which the tape and ribbon are advanced by reciprocal back and forth movement of the cartridge.

Another object of the present invention is to provide a tape-ribbon printing cartridge having an improved means for properly aligning the cartridge within the cartridge carrier and retaining the same therein in an operative position.

A further object of the present invention is to provide an improved means for preventing the tape within the tape supply portion of a printing cartridge from unwinding and settling into the corners of the cartridge.

Another object of the present invention is to provide a tape-ribbon printing cartridge having an improved means for guiding and maintaining separation between the tape and ribbon during withdrawal of the same from the cartridge.

A still further object of the present invention is to provide an improved means for allowing forward movement of the tape and ribbon from the cartridge, but precluding rearward movement of the same back into the cartridge.

These and other objects of the present invention will become apparent with reference to the drawing, the description of the preferred embodiment and the appended claims.

DESCRIPTION OF THE PREFERRED EMBODIMENT

Figure 1:
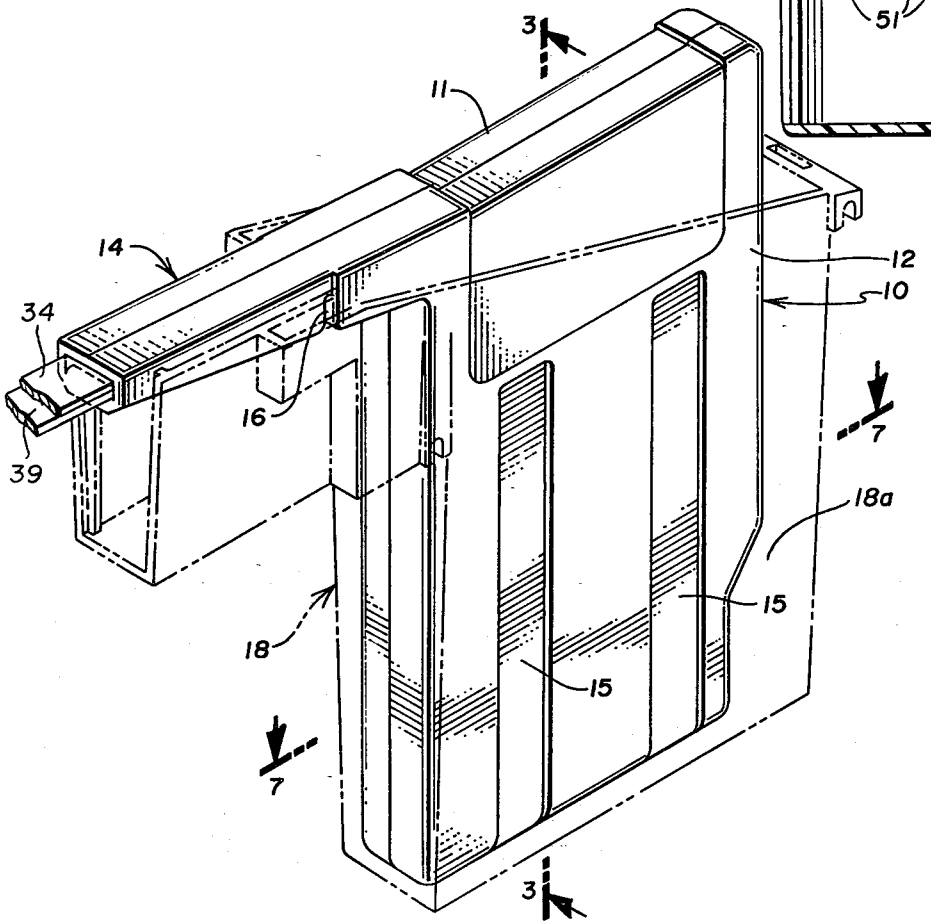
FIG. 1 is a pictorial view of the tape-ribbon cartridge of the present invention with a conventional cartridge carrier or receiver shown in phantom.
Figure 2:
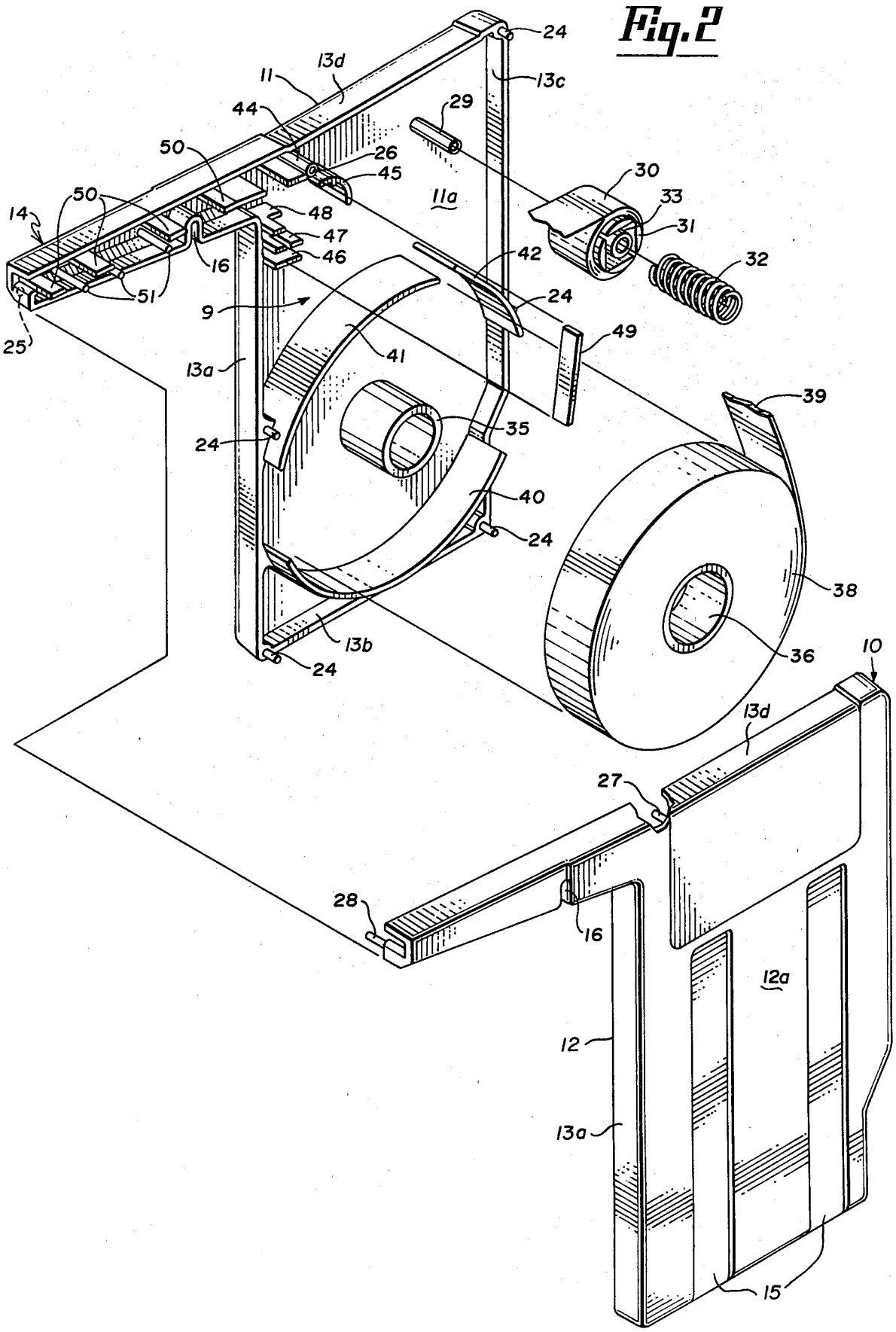
FIG. 2 is a pictorial, broken apart view of the tape-ribbon cartridge of the present invention.

Reference is first made to FIGS. 1 and 2 showing the tape-ribbon printing cartridge of the present invention. FIG. 1 is a pictorial view of the cartridge in its assembled form with a conventional cartridge carrier or receiver 18 illustrated in phantom. FIG. 2 is a pictorial view in which the various parts of the cartridge have been broken apart for better illustration. The tape-ribbon cartridge is illustrated generally by the reference numeral 10 and includes a pair of molded cartridge half sections 11 and 12 adapted for connection with each other to form the configuration illustrated in FIG. 1. When assembled, the cartridge 10 includes a housing having a tape-ribbon supply section 9 and an elongated tape-ribbon guide section 14 extending outwardly from the section 9. The housing includes a cavity defined by a pair of side walls 11*a* and 12*a* and an edge wall 13*a*, 13*b*, 13*c* and 13*d* disposed at right angles with respect to the side walls 11*a* and 12*a* and extending about the periphery thereof. As will be described in greater detail below, the guide section 14 functions to guide the tape 39 and ribbon 34 as they are withdrawn from the cartridge 10 during a printing cycle.

Figure 7:
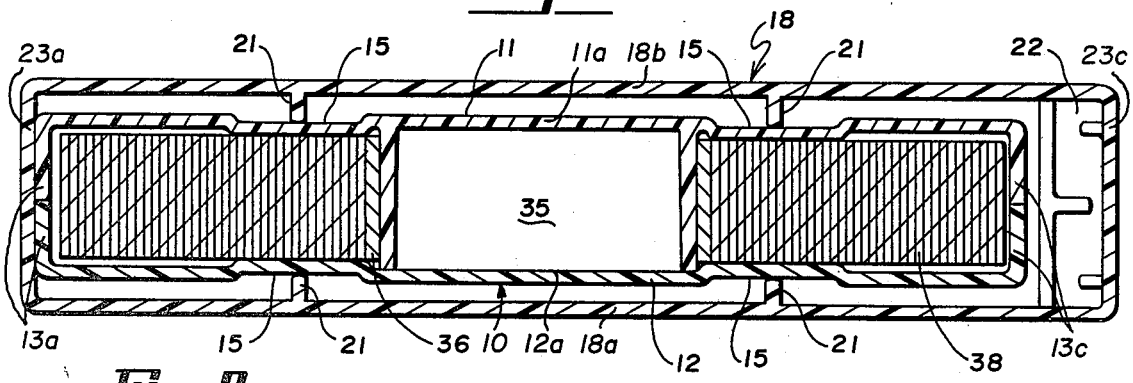
FIG. 7 is a sectional view as viewed along the section line 7—7 of FIG. 1 showing the relationship between the printing cartridge and the cartridge receiver when the printing cartridge is in its operative position.

The exterior surface of each half section 11 and 12 of the cartridge 10 includes a pair of recessed areas 15 adapted for engagement by cooperating rib portions 21 on the inside of the cartridge receiver 18 as illustrated in FIG. 7. These rib portions 21 assist in retaining the cartridge 10 in an operative position within the printing apparatus. As shown best in FIGS. 1, 3 and 7, the cartridge carrier 18 includes a generally rectangular shaped cavity 22 having a pair of generally parallel side walls 18*a* and 18*b*, forward 23*a*, rearward 23*c* and bottom 23*b* edge walls and an open top for insertion of the cartridge 10. The forward portion of the carrier 18 includes a vertically extending wall portion or alignment tab 19 adapted for engagement with the alignment recess or notch 16 in the lower surface of the elongated guide section 14. In the preferred embodiment, the wall or alignment tab 19 is positioned forward of the forward edge wall 23*a* and parallel thereto. The alignment tab 19 and the notch 16 facilitate alignment of the cartridge 10 within the receiver 18 and retention and positive fix of the same in an operative position.

Figure 3:
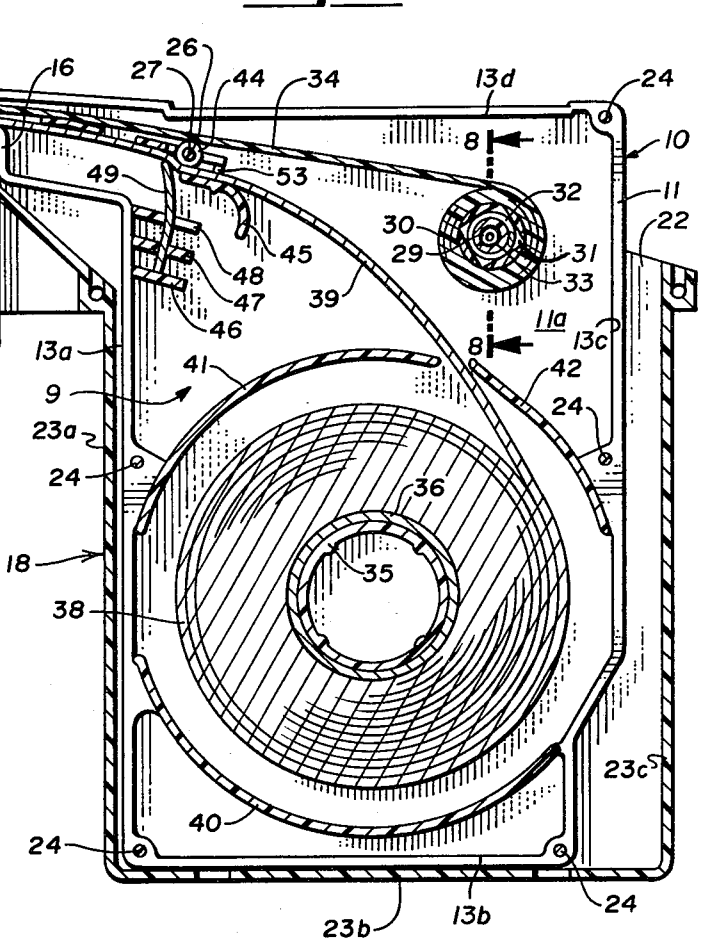
FIG. 3 is a plan view, partially in section, of the tape-ribbon cartridge and cartridge receiver as viewed along the section line 3—3 of FIG. 1.

As illustrated in FIGS. 2 and 3, the pair of rigid cartridge half sections 11 and 12 are plastic molded sections having means for retaining the two sections 11 and 12 together in the operative configuration illustrated in FIG. 1. In particular, the section 11 includes a plurality of posts 24 adapted for engagement with a plurality of corresponding holes (not shown) on the inside surface of the half section 12. The half section 11 also includes a pair of holes 25 and 26 for engagement with corresponding posts 28 and 27 on the inner surface of the half section 12. The posts which mate with the holes 25 and 26 are illustrated in FIG. 2 by the reference numerals 28 and 27, respectively.

Figure 8:
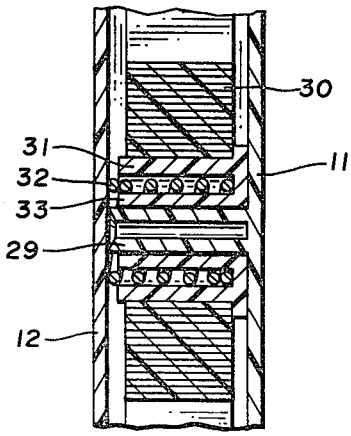
FIG. 8 is a cross sectional view of the ribbon supply means as viewed along the section line 8—8 of FIG. 3.

The main housing of the cartridge 10 when assembled defines a tape-ribbon supply cavity. The half section 11 includes a ribbon supply post 29 integrally formed with the inner surface of the section 11 to rotatably support a supply spool 30 of printing ribbon 34 which is wound onto a spool member 31. As illustrated best in FIGS. 2 and 8, the spool member 31 is rotatably supported with respect to the support post 29 by an integrally formed cylindrical section 33. A coil spring member 32 is disposed in the annular cavity formed between the spool member 31 and cylindrical section 33 with one end in engagement with the inner portion of the annular cavity and its other end biased against the inner surface of the side wall 12*a*. The force exerted by the spring member 32 results in enough frictional engagement between the spool member 31 and the inner surface of the side wall 11*a* and between the spring 32 and the side wall 12*a* to prevent the spool 30 from freewheeling or unwinding as a result of movement of the cartridge 10. The spool 30 provides a supply of printing ribbon 34 to the elongated guide section 14 from which it is withdrawn for use.

The inner surface of the half section 11 also includes a generally cylindrical tape supporting post 35 extending outwardly from an inner surface of the section 11 at right angles. This post 35 rotatably supports the supply spool 38 of image carrying tape 39 via the inner cylindrical member 36. The member 36 is disposed between the supply spool 38 and the post 35 and is adapted for generally free rotation about the post 35. The spool 38 supplies printing tape 39 to the guide section 14 where it can be withdrawn for use during a printing cycle.

The inner surface of the half section 11 also includes means for retaining the supply spool 38 in a generally circular configuration to permit the same to be freely withdrawn from the cartridge 10. In the preferred embodiment, this means includes the three sections 40, 41 and 42 which consist of curved wall sections extending outwardly at right angles from the inner surface of the half section 11. These sections 40, 41 and 42 in conjunction with a portion of the cartridge edge wall 13*c*, form a generally circular configuration to retain the supply spool 38 in a similar circular configuration. If the wall sections 40, 41 and 42 were not present, other means such as foam pads, sticky discs or the like disposed between the sides of the supply spool 38 and the inner surfaces of the sections 11 and 12 would be necessary. Without such means, movement of the cartridge 10 during packaging, shipping, handling, etc. causes the tape 39 to settle into the corners of the cartridge 10, thus forming a configuration which is virtually impossible to unwind. As illustrated, the wall section 42 includes one end which is spaced from the adjacent wall section 41 and is displaced outwardly of the generally circular configuration formed by the wall sections 40, 41 and 42 to permit the tape 39 to be withdrawn from the spool 38 and directed and guided toward the guide section 14. In the preferred embodiment, the wall sections 40, 41 and 42 comprise approximately 275 degrees of the circular configuration and a portion of the edge wall 13*a* and 13*c* of the cartridge 10 provides the remainder.

Figure 4:
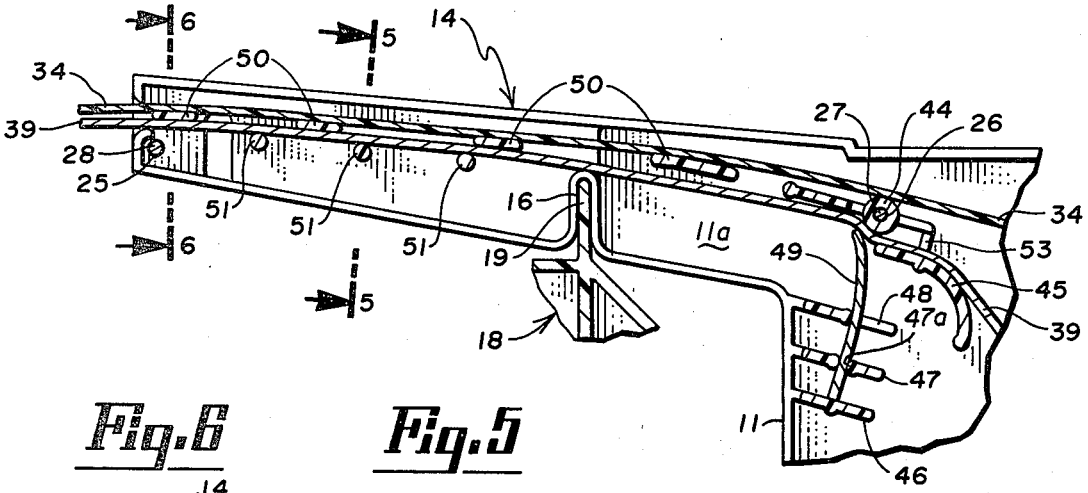
FIG. 4 is an enlarged plan view, partially in section, showing the elongated guide portion of the tape-ribbon cartridge of the present invention.

Reference is next made to FIGS. 2, 3 and 4 showing the means for allowing the tape 39 to be withdrawn from the cartridge 10 through the elongated guide section 14 but which prevents rearward movement of the tape 39 back into the cartridge 10. Thus, such means limits the movement of the tape 39 to movement in a forward direction only. In the preferred embodiment, this means includes bias means 49 having one end in biased engagement with the underside of the tape 39, a post member 44 disposed between and at right angles to the cartridge side walls 11*a* and 12*a* against which the tape 39 is biased by the bias means 49, and guide means for guiding the tape 39 into engagement with a surface of a portion of the post member 44. In the preferred embodiment, the guide means includes the curved wall section 45 integrally formed with the inner surface of the half section 11 and extending outwardly therefrom at right angles. The section 45 supports and guides the tape 39 into proper alignment with the member 44 against which the tape 39 is biased. In the preferred embodiment, the member 44 comprises the post 44 which is integrally formed with the inner surface of the half section 11. The post 44 extends outwardly from the section 11 at right angles and is spaced slightly from the curved wall section 45 to permit passage of the tape 39. Associated with the section 45 is a tape centering portion 53 integrally formed with the side wall 11*a*. The side wall 12*a* includes a similar portion. During withdrawal of the tape 39, the portions 53 center the same between the cartridge half sections 11 and 12. Although the member 44 is shown as a post, it is contemplated that it could also be a roller, a fixed wall or surface or any other means effective to resist the force of the bias means 49. A roller would be particularly suitable for tape with a sticky top surface.

The bias means 49 is a flexible member having one end biasing the tape 39 against the post 44. In the preferred embodiment, the bias means 49 includes a generally rectangular leaf spring member 49 supported within the cartridge 10 by the support ribs 46, 47 and 48. The rib 47 includes a slot 47*a* into which the leaf spring member 49 is disposed, while the lower rib 46 serves mainly as a stop member spring to retain the leaf spring member 49 in its proper position. The upper rib 48 assists in biasing the upper end of the leaf spring member 49 toward the post 44. As illustrated best in FIGS. 3 and 4, the post 44 is positioned to prestress the leaf spring member 49 toward the guide section 14.

In a structure in which the position of the post 44 is fixed, the length of the leaf spring member 49 must be longer than the distance between the rib 46 and the nearest portion of the post 44 to permit the bias force of the spring member 49 to be exerted against the post 44. In the preferred embodiment, the unloaded or unstressed position of the leaf spring member 49 is in line with the center of the post 44; however, because of the length of the spring member 49, its upper end is prestressed toward the left. This results in the exertion of a force against the post 44. The tape 39 is guided toward the post 44 by the surface 45 where it then passes between the upper edge of the leaf spring member 49 and the post 44 toward the elongated guide section 14. This arrangement permits the tape 39 to be withdrawn from the tape supply spool 38 within the cartridge 10 by pulling it against the force of the leaf spring member 49. However, movement of the tape 39 in a reverse direction is precluded because of the binding which occurs between the tape 39, the leaf spring member 49 and the post 44. It is preferable if the top edge of the spring member 49 is relatively sharp to dig into the underside of the tape 39 if an attempt is made to force the tape 39 back into the cartridge 10; however, the binding caused by the force of the spring member 49 toward the post 44 is generally sufficient to preclude rearward movement of the tape 39. It is contemplated that the bias means 49 could also be a wire spring, a spring plastic, spring sheet metal, etc. which would exert a force against the tape 39 into engagement with the post 44. It is also contemplated that the bias means 49 could include a rotatable pawl or ratchet member which is biased into engagement with the tape 39 by a bias member or frictional means disposed within the supply cavity. As illustrated, the leaf spring member 49 is mounted such that in its unstressed position, the spring member 49 is disposed at approximately right angles to the linear movement of the tape 39 into engagement with the post 44.

As shown best in FIGS. 3 and 4, the tape 39 and ribbon 34 are guided from their respective supply spools 38 and 30 through the elongated guide section 14 and outwardly from the cartridge 10. The guiding of the tape 39 and ribbon 34 through the guide section 14 is accomplished by guide means including a plurality of first and second guide posts 50 and 51, respectively. As illustrated best in FIG. 4, the plurality of guide posts or surfaces 50 assist in supporting the ribbon 34 during its withdrawal from the cartridge 10, maintaining separation between the tape 39 and ribbon 34 during withdrawal of the same from the cartridge 10 and providing a guiding surface for the tape 39 to prevent it from buckling in the area between the post 44 and the outer end of the guide section 14. As recited earlier, the cartridge 10 of the present invention is intended to be used in connection with a printing apparatus in which the tape 39 and ribbon 34 are advanced as a result of reciprocal movement of the printing cartridge 10. Thus, the tape 39 and ribbon 34 are advanced by physically moving the carrier 18 and thus the cartridge 10 forward. If there is rearward movement of the tape 39 during this forward movement of the cartridge 10, the spacing of the lettering on the tape 39 will be distorted. Thus, it is important in a cartridge 10 of this type to prevent any rearward movement or buckling of the tape 39 during forward movement of the cartridge 10. The guide surfaces 50, together with the leaf spring member 49, assist in preventing this rearward movement of the tape 39. The guide posts 51 serve primarily to support the tape 39 during its travel through the guide section 14 and to prevent the same from sagging.

Figure 6:
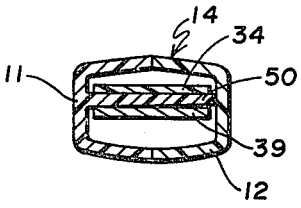
FIG. 6 is a cross sectional view of the elongated guide section as viewed along section line 6—6 of FIG. 4.
Figure 5:
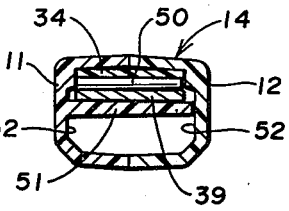
FIG. 5 is a cross sectional view of the elongated guide section as viewed along the section line 5—5 of FIG. 4.

Reference is made next to FIGS. 5 and 6 showing cross-sectional views of the tape 39 and ribbon 34 during their passage through the guide section 14 with the ribbon 34 disposed above the tape 39. As shown, separation between the tape 39 and ribbon 34 is maintained by the plurality of guide posts 50. As the tape 39 is guided through the outer end of the guide section 14, the tape 39 is centered by the inner edges 52 at the forward end.

While the description of the preferred embodiment has been quite specific, it is contemplated that various changes or modifications could be made without deviating from the spirit of the present invention. Accordingly, it is intended that the scope of the present invention be dictated by the appended claims, rather than by the description of the preferred embodiment.

I claim:

1. A printing cartridge for supplying image carrying tape and printing ribbon to a printing station in a printing apparatus comprising:

a substantially closed cartridge housing having a pair of side walls and an edge wall extending about the periphery of said side walls, said cartridge housing including a tape and ribbon supply section and an elongated guide section, rigidly and integrally joined with, and extending outwardly from, said tape and ribbon supply section for guiding said image carrying tape and printing ribbon, one above the other such that a first flat face of said printing ribbon is superimposed over a first flat face of said image carrying tape, from said tape and ribbon supply section toward the printing station of said printing apparatus;

a supply of image carrying tape disposed within said tape and ribbon supply section;

a supply of printing ribbon disposed within said tape and ribbon supply section;

limit means for limiting movement of said image carrying tape from said tape and ribbon supply section in a generally forward direction and preventing movement of said image carrying tape in a rearward direction, said limit means including a bias resisting member disposed between and at right angles to said side walls and between a portion of said image carrying tape and said printing ribbon and bias means for biasing said image carrying tape against said bias resisting member, said bias means including a leaf spring having one end engaging and biasing said image carrying tape against said bias resisting member.

2. The printing cartridge of claim 1 wherein said bias resisting member includes a post member having at least one end joined with a side wall of said housing.

3. The printing cartridge of claim 2 including guide means disposed between said supply of image carrying tape and said post member so as to guide said image carrying tape between said guide means and said post member and into engagement with a surface portion of said post member.

4. The printing cartridge of claim 3 wherein said post member is positioned to prestress said leaf spring toward said elongated guide section.

5. The printing cartridge of claim 4 wherein said leaf spring is mounted such that its unstressed position is disposed at generally right angles to the linear movement of said image carrying tape into engagement with said post member.

6. The printing cartridge of claim 1 wherein said supply of image carrying tape is disposed about a first axis and said elongated guide section includes a plurality of first and second guide posts disposed throughout a substantial portion of the entire length of said elongated guide section and extending laterally across said elongated guide section and generally parallel to said first axis for supporting and guiding said image carrying tape and said printing ribbon in generally unrestricted movement within said elongated guide section, one above the other, during withdrawal from the cartridge.

7. The printing cartridge of claim 6 wherein said plurality of first guide posts are disposed between said image carrying tape and said printing ribbon to maintain separation therebetween during withdrawal from the cartridge.

8. The printing cartridge of claim 7 wherein said first and second guide posts are spaced inwardly from said edge wall and disposed to support and guide said image carrying tape and said printing ribbon in a generally straight line path through said elongated guide section.

9. A printing cartridge system for a printing apparatus comprising:

a printing cartridge receiver having a cartridge receiving cavity, said cavity having a pair of generally parallel side walls, a forward edge wall, a rearward edge wall and a bottom edge wall, said printing cartridge receiver further having an alignment wall positioned forward of and generally parallel to said forward edge wall; and a printing cartridge for insertion into said cartridge receiver having, a housing containing a supply of image carrying tape and printing ribbon, an elongated rigid guide section extending outwardly from said housing for supporting and guiding said image carrying tape and printing ribbon during withdrawal from the cartridge, and an alignment notch disposed on the underside of said elongated rigid guide section for engagement with said alignment wall.

* * * * *